US008958595B2

(12) United States Patent
Hwang et al.

(10) Patent No.: US 8,958,595 B2
(45) Date of Patent: Feb. 17, 2015

(54) PIEZOELECTRIC MICRO SPEAKER HAVING PISTON DIAPHRAGM AND METHOD OF MANUFACTURING THE SAME

(75) Inventors: Jun-sik Hwang, Hwaseong-si (KR); Dong-kyun Kim, Suwon-si (KR); Seok-whan Chung, Suwon-si (KR); Byung-gil Jeong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1373 days.

(21) Appl. No.: 12/696,935

(22) Filed: Jan. 29, 2010

(65) Prior Publication Data

US 2011/0051985 A1 Mar. 3, 2011

(30) Foreign Application Priority Data

Aug. 31, 2009 (KR) ..... 10-2009-0081487

(51) Int. Cl.

*H04R 1/00* (2006.01)
*H04R 17/00* (2006.01)
*H04R 31/00* (2006.01)

(52) U.S. Cl.

CPC ..... *H04R 17/00* (2013.01); *H04R 31/003* (2013.01); *H04R 2201/003* (2013.01); *H04R 2440/07* (2013.01)
USPC ..... 381/396; 381/190

(58) Field of Classification Search

USPC ..... 381/190, 152; 310/311, 348
See application file for complete search history.

(56) References Cited

U.S. PATENT DOCUMENTS

| | | | | |
|---|---|---|---|---|
| 4,430,529 | A | 2/1984 | Nakagawa et al. | |
| 5,209,118 | A | 5/1993 | Jerman | |
| 6,857,501 | B1 | 2/2005 | Han et al. | |
| 2003/0044031 | A1 | 3/2003 | Son | |
| 2005/0226445 | A1 * | 10/2005 | Murray | 381/152 |
| 2006/0002578 | A1 | 1/2006 | Kim et al. | |
| 2007/0013270 | A1 * | 1/2007 | Sashida et al. | 310/348 |
| 2008/0123242 | A1 * | 5/2008 | Zhou | 361/290 |
| 2008/0197751 | A1 * | 8/2008 | Huang | 310/311 |
| 2010/0086151 | A1 * | 4/2010 | Ruiter | 381/190 |
| 2010/0150381 | A1 * | 6/2010 | Lee et al. | 381/190 |
| 2010/0219722 | A1 * | 9/2010 | Onishi et al. | 310/348 |

FOREIGN PATENT DOCUMENTS

| | | | |
|---|---|---|---|
| JP | 577298 | U | 1/1982 |
| JP | 57-107699 | A | 7/1982 |

(Continued)

OTHER PUBLICATIONS

Communication, dated Sep. 17, 2013, issued by the Japanese Patent Office in counterpart Japanese Application No. 2010-154829.

*Primary Examiner* — Duc Nguyen
*Assistant Examiner* — Phan Le
(74) *Attorney, Agent, or Firm* — Sughrue Mion, PLLC

(57) ABSTRACT

Provided are a piezoelectric micro speaker having a piston diaphragm and a method of manufacturing the piezoelectric micro speaker. The piezoelectric micro speaker includes: a substrate having a cavity formed therein; a vibrating membrane that is disposed on the substrate and covers at least a center part of the cavity; a piezoelectric actuator disposed on the vibrating membrane so as to vibrate the vibrating membrane; and a piston diaphragm that is disposed in the cavity and performs piston motion by vibration of the vibrating membrane. When the vibrating membrane vibrates by the piezoelectric actuator, the piston diaphragm, which is connected to the vibrating membrane through a piston bar, performs a piston motion in the cavity.

18 Claims, 6 Drawing Sheets

(56) References Cited

FOREIGN PATENT DOCUMENTS

| | | | |
|---|---|---|---|
| JP | 59139799 | A | 8/1984 |
| JP | 3-124200 | A | 5/1991 |
| JP | 2003304595 | A | 10/2003 |
| JP | 2004120764 | A | 4/2004 |
| JP | 2008-124738 | A | 5/2008 |
| KR | 10-0565202 | B1 | 7/2005 |
| KR | 10-0889032 | B1 | 10/2008 |

* cited by examiner

PIEZOELECTRIC MICRO SPEAKER HAVING PISTON DIAPHRAGM AND METHOD OF MANUFACTURING THE SAME

CROSS-REFERENCE TO RELATED APPLICATION

This application claims priority from Korean Patent Application No. 10-2009-0081487, filed on Aug. 31, 2009, in the Korean Intellectual Property Office, the disclosure of which is incorporated herein in its entirety by reference.

BACKGROUND

1. Field

One or more embodiments relate to a piezoelectric micro speaker, and more particularly, to a piezoelectric micro speaker having a piston diaphragm and a method of manufacturing the piezoelectric micro speaker.

2. Description of the Related Art

Due to rapid development of terminals capable of personal voice communication and data communication, amounts of data transmitted and received has gradually increased accordingly. However, concurrently, terminals are being miniaturized and have diverse functionality.

In this regard, a study on acoustic devices using microelectromechanical systems (MEMS) has been conducted. In particular, by manufacturing micro speakers using a MEMS technique and a semiconductor technique, the micro speakers may be miniaturized, may have reduced costs, and may be easily integrated with peripheral circuits.

The micro speakers using the MEMS technique may be an electrostatic type, an electromagnetic type, or a piezoelectric type. In particular, the piezoelectric type micro speakers may be operated at a lower voltage than the electrostatic type. Also, the piezoelectric type micro speakers may have a simple structure and may be easily made thinner as compared with those of the electromagnetic type.

SUMMARY

One or more embodiments of the present disclosure include a piezoelectric micro speaker having a piston diaphragm that may increase a voice output using piston motion and a method of manufacturing the piezoelectric micro speaker.

Additional aspects will be set forth in part in the description which follows and, in part, will be apparent from the description, or may be learned by practice of the presented embodiments.

According to one or more embodiments, a micro speaker includes: a substrate having a cavity formed therein which penetrates the substrate; a vibrating membrane that is disposed on the substrate and covers at least a center part of the cavity; a piezoelectric actuator disposed on the vibrating membrane, wherein a movement of the piezoelectric actuator vibrates the vibrating membrane; and a piston diaphragm that is disposed in the cavity and is connected to the vibrating membrane, wherein vibration of the vibrating membrane due to the movement of the piezoelectric actuator moves the piston diaphragm.

The micro speaker may further include a piston bar that is disposed at the center part of the cavity and connects the piston diaphragm with the vibrating membrane, wherein the vibration of the vibrating membrane due to movement of the piezoelectric actuator is delivered to the piston diaphragm through the piston bar.

A gap may be formed between a an inner circumferential surface of the cavity and an outer circumferential surface of the piston diaphragm.

The cavity may have a substantially cylindrical shape, and the piston diaphragm may have a substantially circular shape with a diameter smaller than a diameter of the cavity.

The vibrating membrane may cover the entire cavity and the piezoelectric actuator may have an area smaller than the surface area of the cavity.

The piezoelectric actuator may have a bar shape that extends across the center part of the cavity and the vibrating membrane may have a bar shape corresponding to the bar shape of the piezoelectric actuator.

The piezoelectric actuator may have a bar shape that forms a cantilever extending over the center part of the cavity from an upper surface of the substrate and the vibrating membrane may have a bar shape corresponding to the bar shape of the piezoelectric actuator The piezoelectric actuator may include two cantilever piezoelectric actuators extending over the cavity from an upper surface of the substrate at opposite sides of the cavity and the vibrating membrane includes a connection member that extends over the cavity and is connected to the two piezoelectric actuators. In this case, the connection member may be interposed between the two piezoelectric actuators and may have a serpentine shape.

The vibrating membrane may be formed of an insulating material and the piezoelectric actuator may include a first electrode layer disposed on the vibrating membrane, a piezoelectric layer disposed on the first electrode layer, and a second electrode layer disposed on the piezoelectric layer.

According to one or more embodiments, a method of manufacturing a micro speaker includes: forming a cavity in a substrate having a predetermined depth by etching a first side of the substrate; forming a vibrating membrane on the first side of the substrate, covering the cavity; forming a piezoelectric actuator on the vibrating membrane; and forming a piston diaphragm by etching a second side of the substrate, opposite the first side, and forming a trench connected to the edge of the cavity, whereby the piston diaphragm is attached to the vibrating membrane and is separated from the substrate and moveable with respect to the substrate.

In the forming of the cavity, a piston bar may be formed at a center part of the cavity so as to connect the vibrating membrane with the piston diaphragm.

The cavity may have a substantially cylindrical shape, and the piston diaphragm may have a substantially circular shape with a diameter smaller than a diameter of the cavity.

The forming of the vibrating membrane may include: covering the cavity by bonding a silicon-on-insulator (SOI) substrate, in which a first silicon layer, an oxide layer, and a second silicon layer are stacked, to the substrate; removing the second silicon layer and the oxide layer of the SOI substrate; and forming the vibrating membrane on the first silicon layer.

The vibrating membrane may be formed to cover the entire cavity and the piezoelectric actuator may have an area smaller than a cross-sectional area of the cavity.

In the forming of the piezoelectric actuator, the piezoelectric actuator may have a bar shape that extends across a center part of the cavity and after the forming of the piston diaphragm, the vibrating membrane may be patterned to have a bar shape that corresponds to the bar shape of the piezoelectric actuator.

In the forming of the piezoelectric actuator, the piezoelectric actuator may have a bar shape forming a cantilever extending over a center part of the cavity from the first surface of the substrate, and after the forming of the piston diaphragm, the diaphragm may be patterned to have a bar shape corresponding to the bar shape of the piezoelectric actuator.

In the forming of the piezoelectric actuator, the piezoelectric actuator may have the form of two cantilever piezoelectric actuators extending over the cavity from the first surface of the substrate at opposite sides of the cavity, and after the forming of the piston diaphragm, a connection member that connects the two cantilever piezoelectric actuators may be formed by patterning the vibrating membrane. In this case, the connection member may be interposed between the two cantilever piezoelectric actuators and may have a serpentine shape.

BRIEF DESCRIPTION OF THE DRAWINGS

The above and/or other aspects will become apparent and more readily appreciated from the following detailed description of embodiments, taken in conjunction with the accompanying drawings of which.

DETAILED DESCRIPTION

Figure 1:
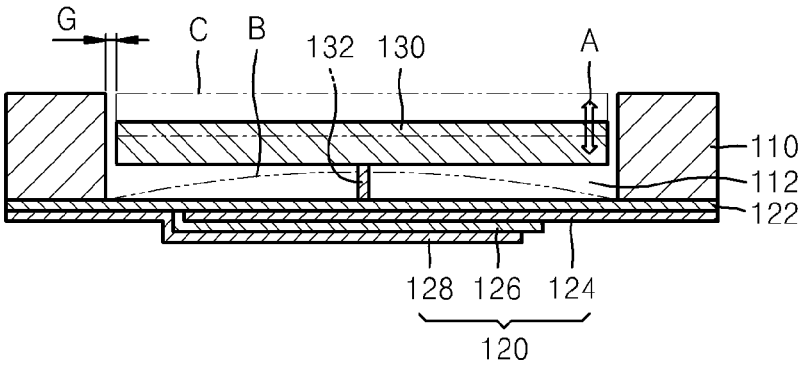
FIG. 1 is a cross-sectional view of a piezoelectric micro speaker according to an embodiment.

Hereinafter, one or more embodiments will be described more fully with reference to the accompanying drawings. However, embodiments are not limited to the embodiments illustrated hereinafter, and the embodiments herein are provided to fully describe to one of ordinary skill in the art to which the present disclosure pertains. In the drawings, like reference numerals denote like elements and the sizes of elements are exaggerated for clarity.

Figure 2:
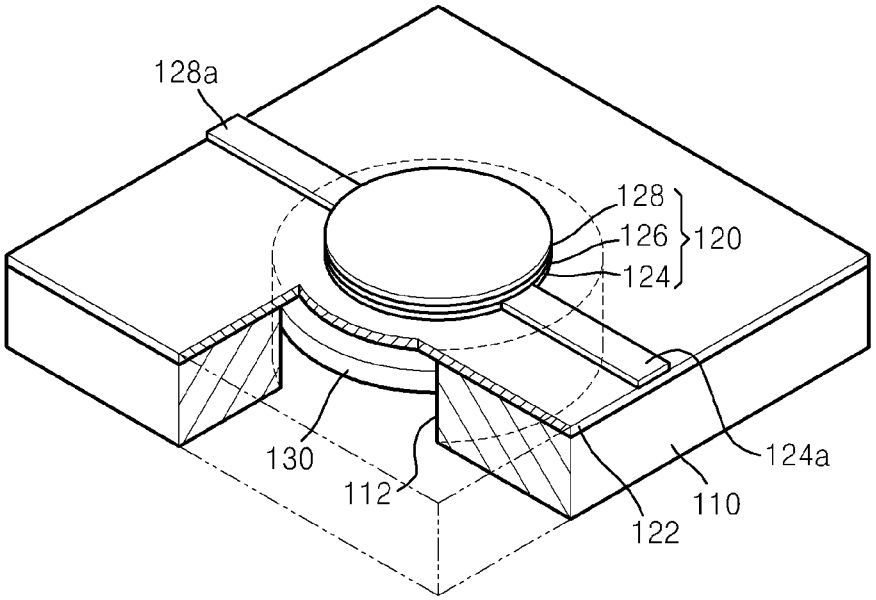
FIG. 2 is a perspective view of the piezoelectric micro speaker of FIG. 1.

FIG. 1 is a cross-sectional view of a piezoelectric micro speaker according to an embodiment and FIG. 2 is a perspective view of the piezoelectric micro speaker of FIG. 1.

Referring to FIGS. 1 and 2, the piezoelectric micro speaker according to the current embodiment includes a substrate 110, a vibrating membrane 122, a piezoelectric actuator 120, and a piston diaphragm 130, wherein the substrate 110 has a cavity 112, the vibrating membrane 122 is formed on the substrate 110 to cover the cavity 112, the piezoelectric actuator 120 is formed on the vibrating membrane 122, and the piston diaphragm 130 is disposed in the cavity 112.

More specifically, the substrate 110 may be formed of a silicon wafer that may be finely micromachined. The cavity 112 may be formed to penetrate a predetermined portion of the substrate 110 in a thickness direction and may have any of various shapes, for example, a cylinder.

The vibrating membrane 122 may be formed having a predetermined thickness on one side of the substrate 110, and may be formed of an insulating material such as a silicon nitride, for example, $Si_3N_4$. The vibrating membrane 122 may be formed to cover at least a center part of the cavity 112, and as illustrated in FIGS. 1 and 2, the vibrating membrane 122 may be formed to cover the entire cavity 112.

The piezoelectric actuator 120 vibrates the vibrating membrane 122 and may include a first electrode layer 124, a piezoelectric layer 126, and a second electrode layer 128 sequentially formed on the vibrating membrane 122 in this order. The first electrode layer 124 and the second electrode layer 128 may be formed of conductive metals and the piezoelectric layer 126 may be formed of a piezoelectric material, for example, aluminum nitride (AlN), zinc oxide (ZnO), or lead zirconate titanate (PZT). The piezoelectric actuator 120 is formed to correspond to the cavity 112 and may have an area smaller than that of the cavity 112. Also, the piezoelectric actuator 120 may have a shape corresponding to that of the cavity 112, for example, a circular plate. The first electrode layer 124 and the second electrode layer 128 included in the piezoelectric actuator 120 may include bar-shaped extension units 124*a* and 128*a* that respectively extend on the substrate 110.

The piston diaphragm 130 is disposed in the cavity 112 and may move in a piston motion due to vibration of the vibrating membrane 122. The piston diaphragm 130 may have a shape corresponding to that of the cavity 112, for example, a circular plate, and have a diameter that is smaller than a diameter of the cavity 112 so as to allow free piston motion in the cavity 112. Accordingly, a predetermined gap G is formed between a circumferential surface of the cavity 112 and a circumferential surface of the piston diaphragm 130. The piston diaphragm 130 may be connected to the vibrating membrane 122 by a piston bar 132 disposed at the center of the cavity 112 and vibration of the vibrating membrane 122 due to the piezoelectric actuator 120 may be delivered to the piston diaphragm 130 through the piston bar 132.

In the piezoelectric micro speaker described above, when a predetermined voltage is applied to the piezoelectric layer 126 through the first electrode layer 124 and the second electrode layer 128, the piezoelectric layer 126 is deformed and the vibrating membrane 122 vibrates. The vibration of the vibrating membrane 122 due to the piezoelectric actuator 120 is delivered to the piston diaphragm 130 through the piston bar 132 and the piston diaphragm 130 moves back and forth in a direction A illustrated with an arrow in FIG. 1, that is, performs piston motion. Due to the piston motion of the piston diaphragm 130, sound may be generated and the generated sound may be emitted to the front of the cavity 112.

The vibrating membrane 122 may be deformed to correspond to an alternate long and two short dashes line B illustrated in FIG. 1 by the piezoelectric actuator 120. Since the vibrating membrane 122 is fixed to the substrate 110 at an edge of the cavity 112, the displacement of the vibrating membrane 122 is the highest at the center of the cavity 112 and decreases at the edge. Accordingly, when sound is generated by only the vibration of the vibrating membrane 122, the degree of deformation of the vibrating membrane 122 is low and thus it may be difficult to obtain a sufficient level of sound.

However, as illustrated in FIGS. 1 and 2, displacement of the vibrating membrane 122 is greatest at the center of the cavity 112. When the piston diaphragm 130 is connected by the piston bar 132 to a portion of the vibrating membrane 122 where maximum displacement occurs, maximum displacement of the piston diaphragm 130 may correspond to the maximum displacement of the vibrating membrane 122. That is, the piston diaphragm 130 is not only displaced at the center thereof but also performs the piston motion as illustrated by an alternate long and two short dashes line C illustrated in FIG. 1 and thus the degree of displacement of the piston diaphragm 130 is greater than that of the vibrating membrane 122. As a result of simulation, a volume between the initial position of the piston diaphragm 130 illustrated with solid lines and the maximum displacement position of the piston diaphragm 130 illustrated with the alternate long and two short dashes line C is greater by 81 times than a volume between the initial position of the vibrating membrane 122 illustrated with solid lines and the maximum transformed position of the vibrating membrane 122 illustrated with the alternate long and two short dashes line B.

As described above, in the piezoelectric micro speaker illustrated in FIGS. 1 and 2, high sound output may be obtained due to the piston motion of the piston diaphragm 130 disposed in the cavity 112. Also, the mass of the piston diaphragm 130 may be adjusted to control resonance frequency.

Figure 3:
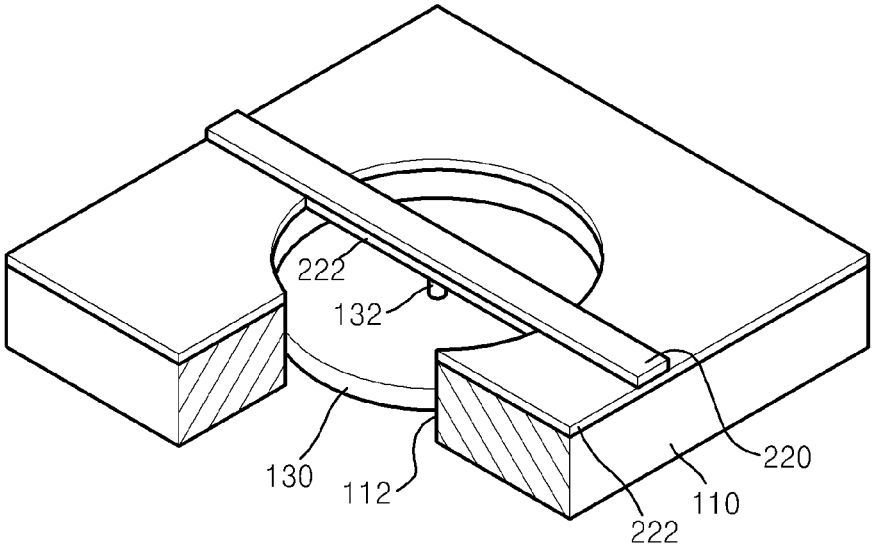
FIG. 3 is a perspective view of a piezoelectric micro speaker according to another embodiment.
Figure 4:
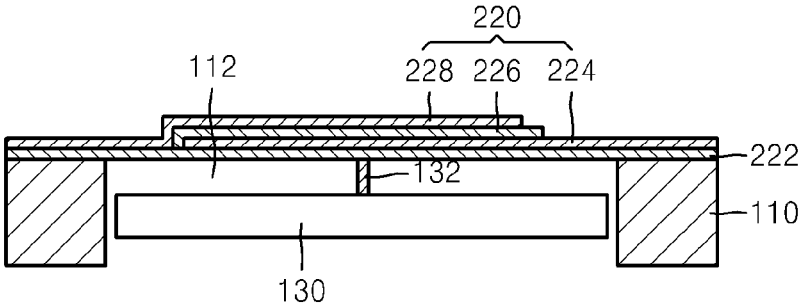
FIG. 4 is a cross-sectional view of the piezoelectric micro speaker illustrated in FIG. 3.

FIG. 3 is a perspective view of a piezoelectric micro speaker according to another embodiment and FIG. 4 is a cross-sectional view of the piezoelectric micro speaker illustrated in FIG. 3.

Referring to FIGS. 3 and 4, a piezoelectric actuator 220 may have the form of a bridge that extends across the center of the cavity 112, for example, the form of a long bar having a predetermined width. The piezoelectric actuator 220 may include a first electrode layer 224, a piezoelectric layer 226, and a second electrode layer 228 sequentially formed on a vibrating membrane 222 in this order. The first electrode layer 224 and the second electrode layer 228 may be formed of conductive metals and the piezoelectric layer 226 may be formed of a piezoelectric material, for example, aluminum nitride (AlN), zinc oxide (ZnO), or lead zirconate titanate (PZT). The vibrating membrane 222 formed on the substrate 110 may have the form of a bridge corresponding to the piezoelectric actuator 220 in the cavity 112. Accordingly, the vibrating membrane 222 covers at least the center part of the cavity 112 and as illustrated in FIG. 3, may not cover the entire cavity 112.

As described above, the piezoelectric actuator 220 having the form of a bridge has a lower structural rigidity than that of the piezoelectric actuator 120 of FIG. 1 and thus a maximum displacement at the center part of the cavity 112 may be greater than with the piezoelectric actuator 120. Accordingly, the maximum displacement of the piston diaphragm 130 connected to the center part of the vibrating membrane 122 by the piston bar 132 increases and thus sound output may also increase.

Figure 5:
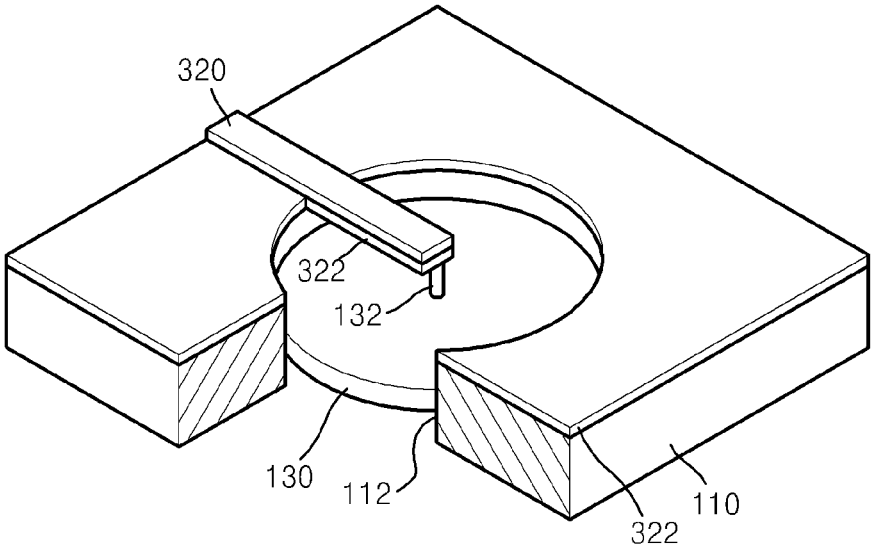
FIG. 5 is a perspective view of a piezoelectric micro speaker according to another embodiment.
Figure 6:
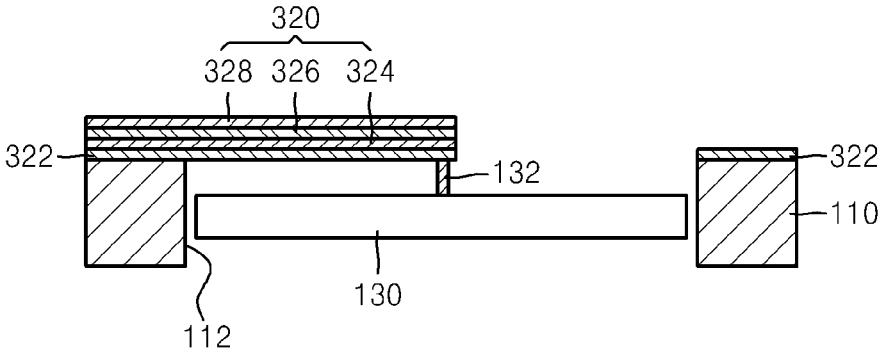
FIG. 6 is a cross-sectional view of the piezoelectric micro speaker illustrated in FIG. 5.

FIG. 5 is a perspective view of a piezoelectric micro speaker according to another embodiment and FIG. 6 is a cross-sectional view of the piezoelectric micro speaker illustrated in FIG. 5.

Referring to FIGS. 5 and 6, a piezoelectric actuator 320 may have the form of a cantilever extended to the center part of the cavity 112 from the upper surface of the substrate 110. The piezoelectric actuator 320 may include a first electrode layer 324, a piezoelectric layer 326, and a second electrode layer 328 sequentially formed on a vibrating membrane 322 in this order. The first electrode layer 324 and the second electrode layer 328 may be formed of conductive metals and the piezoelectric layer 326 may be formed of a piezoelectric material, for example, aluminum nitride (AlN), zinc oxide (ZnO), or lead zirconate titanate (PZT). The vibrating membrane 322 formed on the substrate 110 may have the form of a bar extended to the center of the cavity 112 so as to correspond to the piezoelectric actuator 320. Accordingly, the vibrating membrane 322 is formed to cover at least the center part of the cavity 112 and as illustrated in FIG. 5, may not cover the entire cavity 112.

As described above, the piezoelectric actuator 320 having the form of cantilever may have greater maximum displacement at a position corresponding to the center part of the cavity 112 than that of the piezoelectric actuator 220 of FIG. 3. Accordingly, the maximum displacement of the piston diaphragm 130 connected to the center part of the vibrating membrane 322 by the piston bar 132 increases and thus sound output may also increase.

Figure 7:
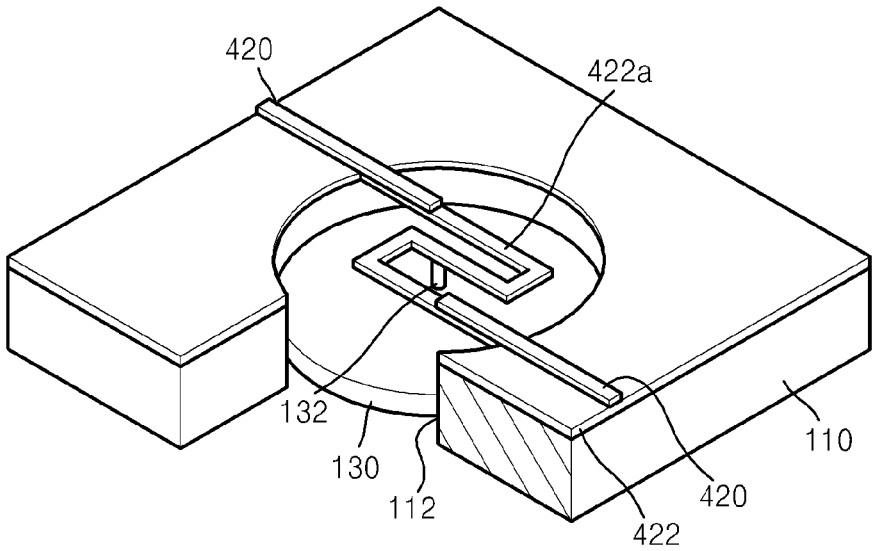
FIG. 7 is a perspective view of a piezoelectric micro speaker according to another embodiment.

FIG. 7 is a perspective view of a piezoelectric micro speaker according to another embodiment.

Referring to FIG. 7, the piezoelectric micro speaker may include two piezoelectric actuators 420 each having the form of a cantilever extended toward the inside of the cavity 112 from an upper surface of the substrate 110 and disposed at opposite sides of the cavity 112. Also, a vibrating membrane 422 formed on the substrate 110 may include a connection member **422*a* extended toward the inside of the cavity 112 and connected to the two piezoelectric actuators 420. The connection member 422*a* is interposed between the two piezoelectric actuators 420 and covers the center part of the cavity 112. The piston bar 132 is connected to the connection member 422*a* of the vibrating membrane 422. The connection member 422*a* may be serpentine as illustrated in FIG. 7** and thus resistance against vibration may be reduced.

As described above, when the piezoelectric micro speaker includes the two cantilever-form piezoelectric actuators 420 and the connection member **422*a* of the vibrating membrane 422 connected to the two cantilever-form piezoelectric actuators 420, the vibrating membrane 422, specifically, the connection member 422*a*, may vibrate with high displacement due to the two cantilever-form piezoelectric actuators 420 and thus the piston diaphragm 130 may perform piston movement with high displacement. In addition, though the two cantilever-form piezoelectric actuators 420 are inclined due to deformation, the connection member 422*a* may be maintained horizontal so that the piston diaphragm 130 connected to the connection member 422*a*** may not be inclined while in the piston motion and may be maintained horizontal.

Hereinafter, a method of manufacturing the piezoelectric micro speaker illustrated in FIGS. 1 and 2 is described.

FIGS. 8A through 8G are cross-sectional views sequentially illustrating a method of manufacturing the piezoelectric micro speaker illustrated in FIGS. 1 and 2.

Figure 8A:
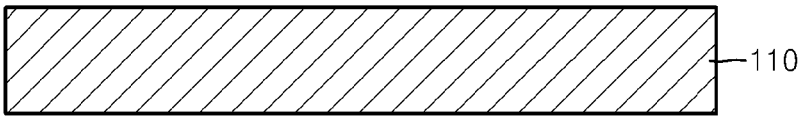
FIGS. 8A through 8G are cross-sectional views sequentially illustrating a method of manufacturing the piezoelectric micro speaker illustrated in FIGS. 1 and 2.

Referring to FIG. 8A, the substrate 110 is prepared, wherein the substrate 110 may be formed of a silicon wafer that may be finely micromachined.

Figure 8B:
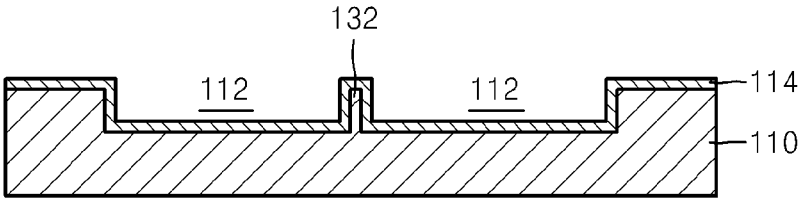

Next, as illustrated in FIG. 8B, one side of the substrate 110 is etched to form the cavity 112 having a predetermined depth and the piston bar 132 projected at the center of the cavity 112. Here, the cavity 112 may be cylindrical. Then, impurities generated on the substrate 110 during the etching process are removed and an oxide layer 114 may be formed on a surface on which the cavity 112 is formed.

Figure 8C:
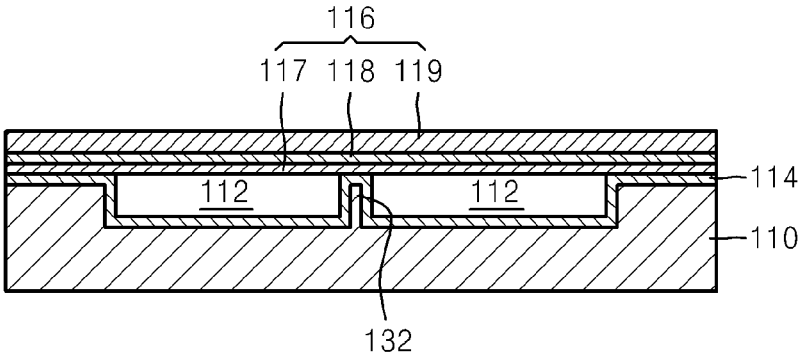
Figure 8D:
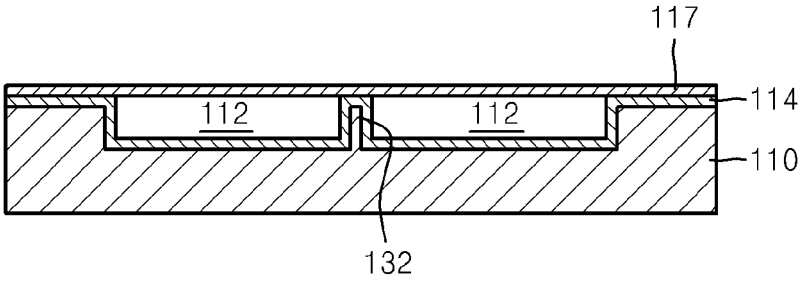
Figure 8E:
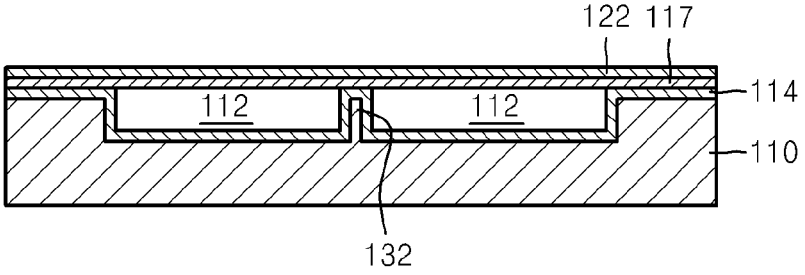

As illustrated in FIGS. 8C through 8E, the vibrating membrane 122 is formed on the one side of the substrate 110 to cover the cavity 112.

More specifically, as illustrated in FIG. 8C, a silicon-on-insulator (SOI) substrate 116 is bonded to the substrate 110 so as to cover the cavity 112. Here, a bonding method may include fusion bonding and other bonding methods, such as anodic bonding, diffusion bonding, or thermal-compress bonding, may be used. The SOI substrate 116 may have a stacked structure in which a first silicon layer 117, an oxide layer 118, and a second silicon layer 119 are sequentially stacked in this order. Then, as illustrated in FIG. 8D, the second silicon layer 119 and the oxide layer 118 included in the SOI substrate 116 are removed by using etching or chemical mechanical polishing (CMP) and thus only the first silicon layer 117 remains. Then, an insulating material such as a silicon nitride, for example, $Si_3N_4$, is deposited on the first silicon layer 117 and thus the vibrating membrane 122 is formed.

Figure 8F:
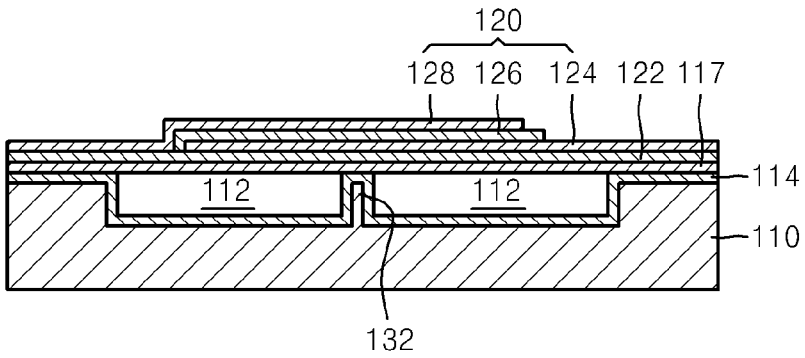

Then, as illustrated in FIG. 8F, the first electrode layer 124, the piezoelectric layer 126, and the second electrode layer 128 are sequentially formed in this order on the vibrating membrane 122 so as to form the piezoelectric actuator 120. Here, the piezoelectric actuator 120 is formed at position corresponding to the cavity 112 and may have an area smaller than that of the cavity 112. Also, the piezoelectric actuator 120 may have the form corresponding to the form of the cavity 112, for example, a circular plate. More specifically, the first electrode layer 124 may be formed by depositing a conductive metal material, for example, Au, Mo, Cu, Al, Pt, or Ti on the vibrating membrane 122 to a thickness of about 0.1 μm to 3 μm via sputtering or evaporation and then patterning the conductive metal material to have a predetermined form. The piezoelectric layer 126, which is formed of a piezoelectric material, for example, AlN, ZnO, or PZT, may be formed on the first electrode layer 124 to a thickness of about 0.1 μm to 3 μm via sputtering or spinning. The second electrode layer 128 may be formed on the piezoelectric layer 126 in the same manner as in the method of forming the first electrode layer 124.

Figure 8G:
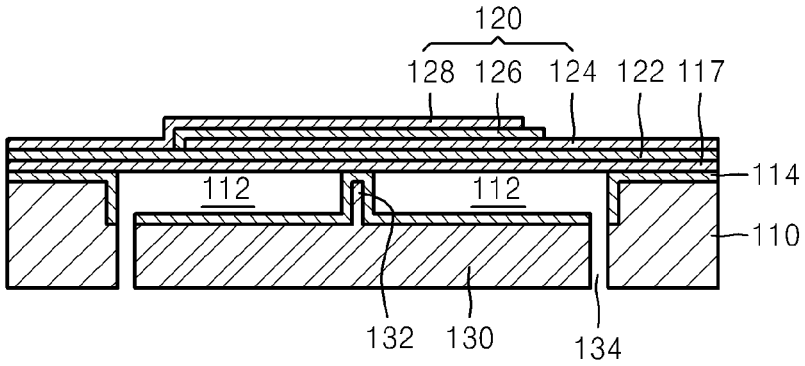

Next, as illustrated in FIG. 8G, a side of the substrate 110 opposite the cavity 112 is etched to form a trench 134 communicating with the edge of the cavity 112. Then, the piston diaphragm 130 separated from the substrate 110 by the trench 134 is formed.

Accordingly, the vibrating membrane 122 and the piezoelectric actuator 120 are formed on the substrate 110 thereby manufacturing the piezoelectric micro speaker, in which the piston diaphragm 130 is disposed in the cavity 112 of the substrate 110.

Moreover, the piezoelectric micro speakers illustrated in FIGS. 3, 5, and 7 may be manufactured by using the method illustrated in FIGS. 8A through 8G. However, in manufacturing the piezoelectric micro speaker illustrated in FIG. 3, the piezoelectric actuator 220 is formed as a bridge that passes across the center part of the cavity 112 in the process illustrated in FIG. 8F. After the process illustrated in FIG. 8G, the vibrating membrane 222 is patterned to have the form of a bridge that corresponds to the piezoelectric actuator 220. In manufacturing the piezoelectric micro speaker illustrated in FIG. 5, the piezoelectric actuator 320 is formed in the form of a cantilever extended to the center part of the cavity 112 from the upper surface of the substrate 110 in the process illustrated in FIG. 8F. After the process illustrated in FIG. 8G, the vibrating membrane 322 is patterned to have the form of a bar extended to the center part of the cavity 112 so as to correspond to the piezoelectric actuator 320. In manufacturing the piezoelectric micro speaker illustrated in FIG. 7, the two piezoelectric actuators 420 are formed as a cantilever extended toward the inside of the cavity 112 from the upper surface of the substrate 110 at opposites sides of the cavity 112 in the process illustrated in FIG. 8F. After the process illustrated in FIG. 8G, the connection unit 422*a*, which is connected to the two piezoelectric actuators 420, may be further formed by etching the vibrating membrane 422. Here, the connection unit 422*a* may be serpentine.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A micro speaker comprising:

a substrate having a cavity formed therethrough in a thickness direction of the substrate;

a vibrating membrane that is disposed on the substrate and covers at least a center part of the cavity;

a piezoelectric actuator disposed on the vibrating membrane, wherein a movement of the piezoelectric actuator vibrates the vibrating membrane;

a piston diaphragm that is disposed in the cavity and is connected to the vibrating membrane; and a piston bar that is disposed at the center part of the cavity and connects the piston diaphragm with the vibrating membrane, wherein vibration of the vibrating membrane due to the movement of the piezoelectric actuator is delivered to the piston diaphragm through the piston bar, and the piston bar and the piston diaphragm are formed as a single body.

2. The micro speaker of claim 1, wherein a gap is formed between an inner circumferential surface of the cavity and an outer circumferential surface of the piston diaphragm.

3. The micro speaker of claim 1, wherein the cavity has a substantially cylindrical shape, and the piston diaphragm has a substantially circular shape.

4. The micro speaker of claim 3, wherein an outer diameter of the piston diaphragm is smaller than an inner diameter of the cavity.

5. The micro speaker of claim 1, wherein the vibrating membrane covers the entire cavity and the piezoelectric actuator has a cross-sectional area smaller than that of the cavity.

6. The micro speaker of claim 1, wherein the piezoelectric actuator has a bar shape and extends across the center part of the cavity, and the vibrating membrane has a bar shape corresponding to the bar shape of the piezoelectric actuator.

7. The micro speaker of claim 1, wherein the piezoelectric actuator has a bar shape and forms a cantilever extending over the center part of the cavity from an upper surface of the substrate, and the vibrating membrane has a bar shape corresponding to the bar shape of the piezoelectric actuator and extends to the center part of the cavity.

8. The micro speaker of claim 1, wherein the piezoelectric actuator comprises two cantilever piezoelectric actuators extending over the cavity from an upper surface of the substrate at opposite sides of the cavity and the vibrating membrane comprises a connection member that extends over the cavity, and is connected to the two cantilever piezoelectric actuators.

9. The micro speaker of claim 8, wherein the connection member is interposed between the two cantilever piezoelectric actuators and has a serpentine shape.

10. The micro speaker of claim 1, wherein the vibrating membrane comprises an insulating material and the piezoelectric actuator comprises a first electrode layer disposed on the vibrating membrane, a piezoelectric layer disposed on the first electrode layer, and a second electrode layer disposed on the piezoelectric layer.

11. A method of manufacturing a micro speaker, the method comprising:

forming a cavity having a predetermined depth in a substrate by etching a first side of the substrate;

forming a vibrating membrane on the first side of the substrate, the vibrating membrane covering the cavity on the first side of the substrate, and forming a piston bar which vertically protrudes from the substrate and which is formed as a single body with the substrate, at a center part of the cavity;

forming a piezoelectric actuator on the vibrating membrane, the vibrating membrane being connected to the piston bar; and forming a piston diaphragm by etching a second side of the substrate, opposite the first side, and forming a trench connected to the edge of the cavity, wherein the piston diaphragm is attached to the vibrating membrane via the piston bar and is separated from the substrate and moveable with respect to the substrate.

12. The method of claim 11, wherein the cavity has a substantially cylindrical shape and the piston diaphragm has a substantially circular shape with a diameter smaller than a diameter of the cavity.

13. The method of claim 11, wherein the forming the vibrating membrane comprises:

covering the cavity by bonding a silicon-on-insulator (SOI) substrate to the substrate, the SOI substrate comprising a first silicon layer, an oxide layer, and a second silicon layer;

removing the second silicon layer and the oxide layer of the SOI substrate; and forming the vibrating membrane on the first silicon layer.

14. The method of claim 11, wherein the forming the vibrating membrane comprises forming the vibrating membrane to cover the entire cavity and the piezoelectric actuator has a surface area smaller than a surface area of the cavity.

15. The method of claim 11, wherein, the piezoelectric actuator has a bar shape and extends across a center part of the cavity and the method further comprising, after the forming of the piston diaphragm, patterning the vibrating membrane to have a bar shape that corresponds to the bar shape of the piezoelectric actuator.

16. The method of claim 11, wherein the piezoelectric actuator has a bar shape and forms a cantilever extending over a center part of the cavity from the first surface of the substrate, and the method further comprising, after the forming of the piston diaphragm, patterning the vibrating membrane to have the form of a bar shape corresponding to the bar shape of the piezoelectric actuator.

17. The method of claim 11, wherein the piezoelectric actuator comprises two cantilever piezoelectric actuators extending over the cavity from the first surface of the substrate at opposite sides of the cavity, and the method further comprising, after the forming of the piston diaphragm, patterning the vibrating membrane to form a connection member that connects the two cantilever piezoelectric actuators.

18. The method of claim 17, wherein the connection unit is interposed between the two cantilever piezoelectric actuators and has a serpentine shape.

* * * * *